US009597788B2

(12) United States Patent
Moessnang et al.

(10) Patent No.: US 9,597,788 B2
(45) Date of Patent: Mar. 21, 2017

(54) HANDHELD POWER TOOL

(71) Applicant: Hilti Aktiengesellschaft, Schaan (LI)

(72) Inventors: Franz Moessnang, Stadtbergen (DE); Ralf Greitmann, Kaufering (DE); Markus Hartmann, Mauerstetten (DE); Manfred Ludwig, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 786 days.

(21) Appl. No.: 13/766,087

(22) Filed: Feb. 13, 2013

(65) Prior Publication Data

US 2014/0054056 A1 Feb. 27, 2014

(30) Foreign Application Priority Data

Feb. 15, 2012 (DE) ..... 10 2012 202 278

(51) Int. Cl.
*B25D 16/00* (2006.01)
*B25F 5/00* (2006.01)

(52) U.S. Cl.
CPC ..... *B25D 16/006* (2013.01); *B25F 5/001* (2013.01); *B25D 2216/0015* (2013.01);
(Continued)

(58) Field of Classification Search
CPC ..... B25D 16/006; B25D 2250/255; B25D 2216/0023; B25D 2250/371;
(Continued)

(56) References Cited

U.S. PATENT DOCUMENTS 6,192,996 B1 2/2001 Sakaguchi
6,520,267 B2 * 2/2003 Funfer ..... B25D 16/006 173/170
(Continued)

FOREIGN PATENT DOCUMENTS

CN 2626128 Y 7/2004
CN 1181576 C 12/2004
(Continued)

OTHER PUBLICATIONS

Comments re Cited Document 2 from corresponding Japanese application No. 2013-025821.

*Primary Examiner* — Robert Long
*Assistant Examiner* — Xavier A Madison
(74) *Attorney, Agent, or Firm* — Davidson, Davidson & Kappel, LLC

(57) ABSTRACT

A handheld power tool has a switchable gear component actuatable by a selector switch. The gear component moves from a first operating position into a second operating position. The selector switch has a first switching position associated with the first operating position and a second switching position associated with the second operating position, and movable so that intermediate positions are assumed. A traveling coupling between the selector switch and the gear component has a spring exerting force onto the gear component in the first direction. A locking bolt is coupled to the selector switch in a positively driven manner. In the intermediate positions, the locking bolt is moved into a blocking bolt position blocking movement of the gear component out of the first operating position into the second operating position. When the selector switch is in the second switching position, the locking bolt is in a releasing bolt position.

7 Claims, 5 Drawing Sheets

(52) U.S. Cl.
CPC ..... *B25D 2216/0023* (2013.01); *B25D 2216/0038* (2013.01); *B25D 2216/0069* (2013.01); *B25D 2250/255* (2013.01); *B25D 2250/371* (2013.01)

(58) Field of Classification Search
CPC .... B25D 2216/0038; B25D 2216/0015; B25D 2216/0069; B25F 5/001
USPC ..... 173/48
See application file for complete search history.

(56) References Cited

U.S. PATENT DOCUMENTS

| | | | | |
|---|---|---|---|---|
| 7,331,496 | B2 | 2/2008 | Britz et al. | |
| 7,607,493 | B2 | 10/2009 | Erhardt et al. | |
| 2006/0108133 | A1* | 5/2006 | Yamazaki ..... | B25D 11/005 173/104 |
| 2006/0185866 | A1 | 8/2006 | Jung et al. | |
| 2010/0218965 | A1 | 9/2010 | Guenther | |
| 2012/0234568 | A1 | 9/2012 | Schnell et al. | |

FOREIGN PATENT DOCUMENTS

| | | |
|---|---|---|
| CN | 1824465 A | 8/2006 |
| DE | 36 18 024 | 12/1987 |
| DE | 40 00 822 | 7/1991 |
| DE | 44 41 793 | 5/1996 |
| DE | 10 2004 018 084 | 11/2005 |
| DE | 10 2009 028 622 | 2/2011 |
| EP | 1 166 696 | 1/2002 |
| EP | 1886768 | 2/2008 |
| JP | 4947015 | 12/1974 |
| JP | 2001054881 | 2/2001 |
| JP | 2001071281 | 3/2001 |
| JP | 2002262411 | 9/2002 |
| JP | 2002274798 | 9/2002 |

* cited by examiner

HANDHELD POWER TOOL

This claims the benefit of German Patent Application DE 10 2012 202 278.3, filed Feb. 15, 2012 and hereby incorporated by reference herein.

The present invention relates to a handheld power tool that allows various modes of operation. The various modes of operation encompass two or more of the following examples: purely chiseling operation, hammer-drilling operation, purely turning/drilling operation, two different speeds, etc. A user can select the mode of operation by means of a selector switch. The selector switch interacts with a gear and mechanically disconnects and activates the appropriate drive trains.

SUMMARY OF THE INVENTION

It is an object of the present invention to provide a handheld power tool that has a switchable gear component that can be actuated by a selector switch. The gear component can be moved out of a first operating position into a second operating position along a first direction, and it can be moved in a second direction, typically opposite from the first direction, back into the first operating position. The selector switch has a first switching position associated with the first operating position of the gear component, and a second switching position associated with the second operating position of the gear component. The selector switch can be moved between the first switching position and the second switching position, a process in which intermediate positions are reached. The intermediate positions are not associated with any operating position of the gear component. A springy traveling coupling is coupled between the selector switch and the gear component in such a way that, when the selector switch is moved out of the first switching position into the second switching position, a spring of the traveling coupling exerts force onto the gear component in the first direction. When the selector switch is moved out of the second switching position into the first switching position, the springy traveling coupling can also exert force onto the gear component in the second direction by means of the same spring or another spring. A locking bolt is coupled to the selector switch in a positively driven manner. When the selector switch is in the intermediate positions of the selector switch, the locking bolt is moved into a blocking bolt position in which the locking bolt blocks movement of the gear component out of the first operating position into the second operating position. Moreover, in the intermediate positions, the locking bolt can also block movement of the gear component out of the second operating position into the first operating position. When the selector switch is in the first switching position or in the second switching position, the locking bolt is in a releasing bolt position in which the locking bolt does not block movement of the gear component.

The traveling coupling and its internal spring are tensioned when the selector switch is actuated by the user. The spring tension, however, is not released until the selector switch has reached one of the switching positions. In the switching position, the spring is completely relaxed or else at least partially relaxed in that the gear component is moved. However, if the user leaves the selector switch in an intermediate position, the locking bolt blocks and the gear component remains in its previous operating position. The user will intuitively recognize that the selector switch has not yet moved far enough, that is to say, to the next switching position. The spring can be designed to be so strong that the return of the spring pushes the selector switch back into its previous switching position when the user lets go of the selector switch.

The selector switch preferably latches in the switching positions and does not have any intermediate latching positions. A latching element can be provided on the housing of the handheld power tool. The latching element latches with the selector switch in the first switching position and in the second switching position but it does not latch in any of the intermediate positions. The selector switch, for example, in its outer surface, has two depressions arranged offset along the direction of movement of the selector switch, whereby the pawl engages into said depressions. The outer surface is smooth between the depressions. The latching element is made up, for example, of a leaf spring with a catch. By the same token, the pawl can be provided on the selector switch and the depressions can be provided on the housing.

The selector switch can be moved in a direction oblique or perpendicular to the first direction, that is to say, to the direction of movement of the gear component, in order to reach the first and second switching positions. The locking bolt can likewise be moved obliquely or perpendicularly to the first direction between blocking positions and the releasing positions. In one preferred embodiment, the selector switch can be rotated around an axis. The locking bolt is attached to the selector switch eccentrically with respect to the axis. The selector switch rotates the locking bolt along around the axis.

According to one embodiment, the gear component has a locking pin with whose side facing in the first direction, preferably also with the side facing away from it, the locking bolt can be in contact in the blocking bolt positions. In the releasing bolt positions, the locking bolt is completely offset relative to the pin in a direction perpendicular to the direction of movement of the gear component, that is to say, without overlapping in a projection onto a plane perpendicular to the direction of movement. When a change is made out of the first operating position into the second operating position, the locking bolt is guided along a first trajectory. When a change is made out of the first switching position into the second switching position, the locking bolt is guided along a second trajectory. The first trajectory and the second trajectory intersect each other. This results in the blocking bolt positions for the intermediate positions of the selector switch.

In one of the blocking bolt positions, the pin is in contact with the locking bolt in the first direction, and the spring exerts force onto the pin in the first direction. These blocking bolt positions are reached when the gear component is still in the first operating position. In the other bolt positions, the pin is in contact with the locking bolt in the first direction and the spring exerts force onto the pin opposite from the first direction. These other blocking bolt positions are reached when the gear component is still in the second operating position.

When the locking bolt is rotating, it is at a fixed first distance from the axis. The rotating locking bolt is preferably non-rotatably connected to the selector switch. According to one embodiment, the gear component has a protruding locking pin that, in the first operating position, is at a second distance from the axis, and that, in the second operating position, is at a third distance from the axis. The first distance between the locking bolt and the axis is smaller than the second distance and greater than the third distance. The locking bolt can preferably come into contact with the two opposing sides of the locking pin. The one locking pin and the locking bolt can block movement in both directions.

Moreover, movement of the selector switch is not hindered by the locking pin and the locking bolt.

The rotating locking bolt may have a first stop surface that faces opposite from the first direction and that is at the first distance from the axis. The pin has a second stop surface facing in the first direction, whereby, in the first operating position, the second stop surface is at a second distance from the axis, and, in a second operating position, it is at a third distance from the axis. The arrangement and the dimensions of the pin are such that the second distance is smaller than or equal to the first distance, and the third distance is greater than the first distance. The pin and the locking bolt can be configured symmetrically for the direction of movement that is opposite from the first direction of movement. For this purpose, the locking bolt has a third stop surface that faces in the first direction and that is at a fourth distance from the axis. The pin correspondingly has a fourth stop surface facing opposite from the first direction. In the first operating position, the fourth stop surface is at a fifth distance from the axis and, in the second operating position, at a sixth distance from the axis. The arrangement and the dimensions of the pin and of the bolt are such that the fifth distance is greater than or equal to the fourth distance, and the sixth distance is smaller than the fourth distance.

In a preferred embodiment, the dimensions can be selected as follows. The first stop surface and the third stop surface of the locking bolt facing away from the first stop surface are at a seventh distance, and the seventh distance corresponds to the width of the pin. An eighth distance is defined as the distance between the second stop surface in the second operating position and the fourth stop surface of the locking bolt facing away from the second stop surface in the first operating position. The eighth distance corresponds to the sum resulting from the width of the locking bolt and the movement path of the gear component. The eighth distance is greater than the width of the locking bolt. This ensures that, in the operating positions, the springy traveling coupling moves the pin out of the swiveling range of the locking bolt. In no position does the pin hinder the operation of the selector switch, which is rigidly connected to the locking bolt.

In one embodiment, the traveling coupling has a rotary disk that can be rotated around the axis. The spring is firmly joined to the selector switch at one end and to the rotary disk at the other end. An eccentric finger on the rotary disk engages into a link that runs obliquely or perpendicularly to the first axis and that is situated on the gear component. The spring is preferably a spiral spring arranged concentrically to the axis. The spring can be deflected under tension around the axis out of a resting position in a first direction of rotation, and in a second direction of rotation that is opposite from the first direction of rotation.

One embodiment provides that a ninth distance of the eccentric finger from the axis is smaller than the first distance between the locking bolt and the axis.

One embodiment provides that, in the first operating position, the switchable gear component engages with mating gears and, in the second operating position, disengages from the mating gears. One of the gearwheels can be mounted on the gear component so that it can rotate around the first direction.

The handheld power tool can perform a turning-chiseling operation in the first operating position and a purely chiseling operation in the second operating position. The handheld power tool is, for instance, a hammer drill with a pneumatic striking mechanism. The two operating positions can serve to set two different speeds of a driven spindle, for example, for an electric screwdriver, a motor-driven saw or a grinding or drilling power tool, especially a handheld power tool.

BRIEF DESCRIPTION OF THE DRAWINGS

The description below explains the invention on the basis of embodiments and figures provided by way of examples. The figures show the following.

DETAILED DESCRIPTION

Figure 1:
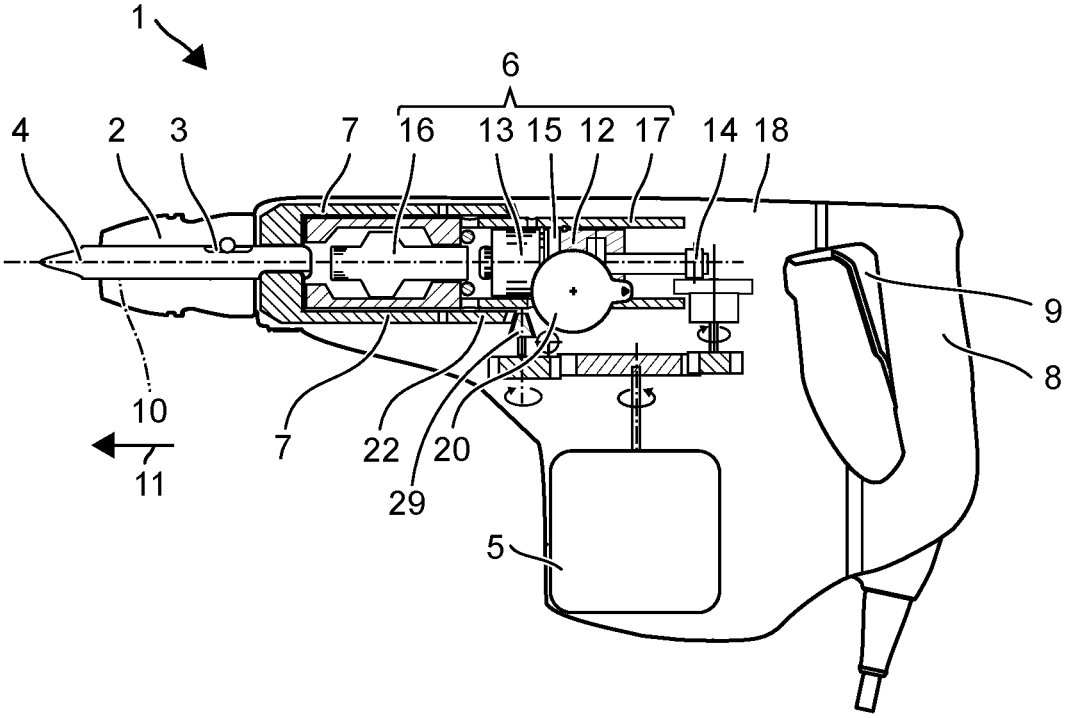
FIG. 1: a hammer drill.

Unless otherwise indicated, the same or functionally identical elements are designated by the same reference numerals in the figures.

FIG. 1 schematically shows a hammer drill 1 as an example of a chiseling handheld power tool. The hammer drill 1 has a tool socket 2 into which the one shank end 3 of a tool for example, a drill bit 4, can be inserted. A motor 5 that drives a striking mechanism 6 and a driven shaft 7 forms a primary gear of the hammer drill 1. A user can hold the hammer drill 1 by means of a handle 8 and can start up the hammer drill 1 by means of a system switch 9. During drilling operation, the hammer drill 1 continuously rotates the drill bit 4 around a working axis 10, and hammers the drill bit 4 into a substrate in the striking direction 11 along the working axis 10. In the case of a purely chiseling operation, the driven shaft 7 is uncoupled from the motor 5.

The striking mechanism 6 is, for example, a pneumatic striking mechanism. An exciter 12 and a striker 13 are movably installed in the striking mechanism 6 along the working axis 10. The exciter 12 is coupled to the motor 5 via a cam 14 or a toggle finger, and it is forced to execute a periodical, linear movement. An air spring formed by a pneumatic chamber 15 between the exciter 12 and the striker 13 couples a movement of the striker 13 to the movement of the exciter 12. The striker 13 can strike a rear end of the drill bit 4 either directly or else it can indirectly transfer some of its pulse to the drill bit 4 via an essentially resting intermediate striker 16. The exciter 12 and the striker 13 can be pistons that slide in a guide tube 17.

The motor 5, the striking mechanism 6 and preferably the other drive components are arranged inside a machine housing 18. Electric energy is supplied via a mains connection or by means of a battery pack.

The hammer drill 1 has a selector switch 20 with which the user can couple and uncouple the gear shaft 7 from the motor 5. The driven shaft 7 provided by way of an example can be coupled and uncoupled by means of the selector switch 20 with a driving pinion 22.

Figure 2A:
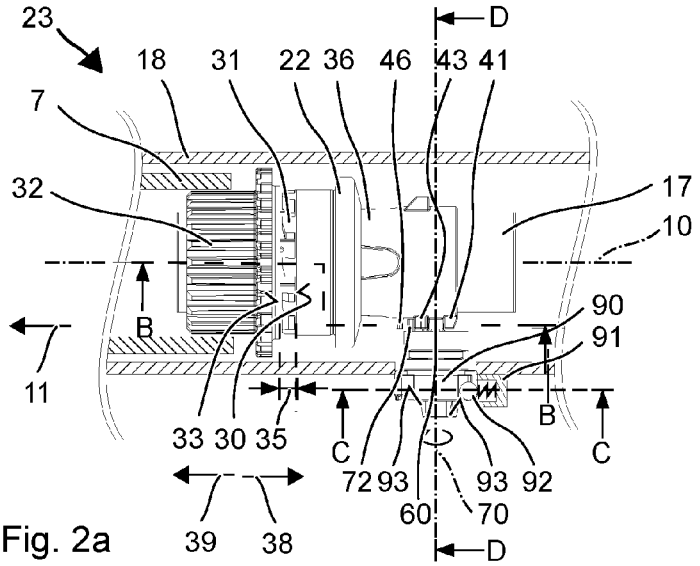
FIGS. 2*a*-2*e*: a gear with a selector switch in a first switching position.
Figure 2B:
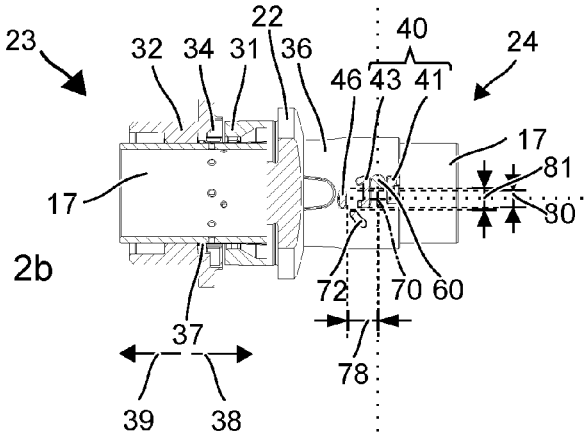
Figure 2D:
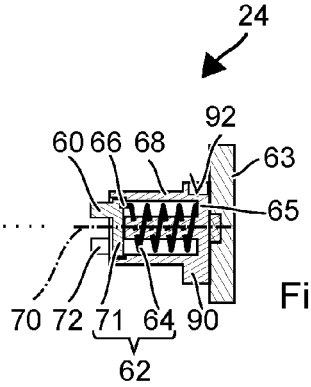
Figure 2C:
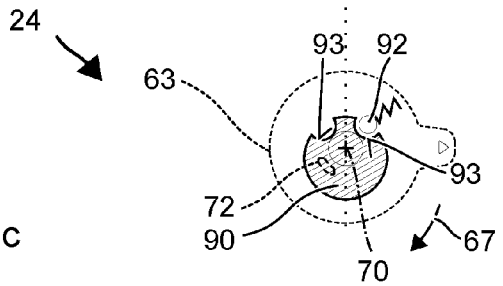
Figure 2E:
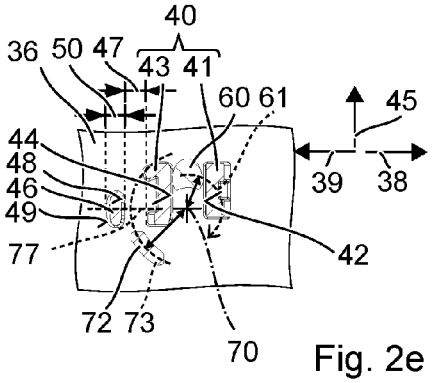
Figure 3A:
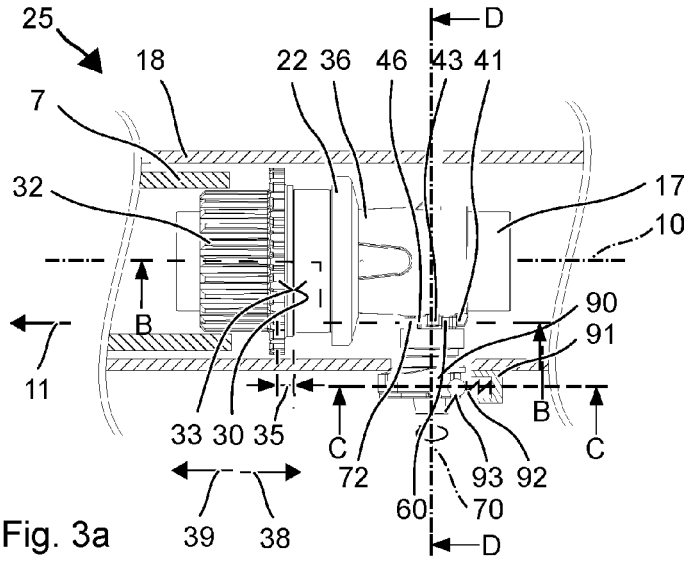
FIGS. 3*a*-3*e*: the gear with a selector switch in a second switching position.
Figure 3B:
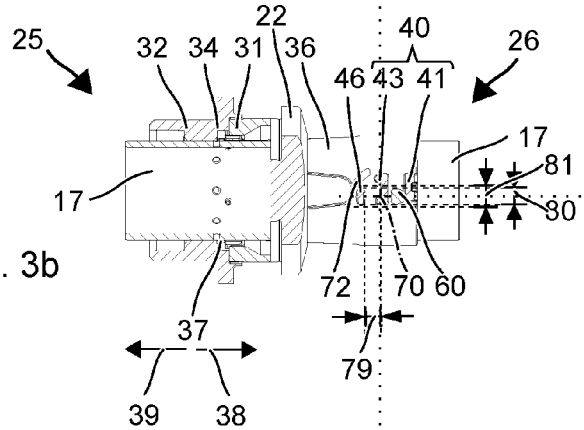
Figure 3D:
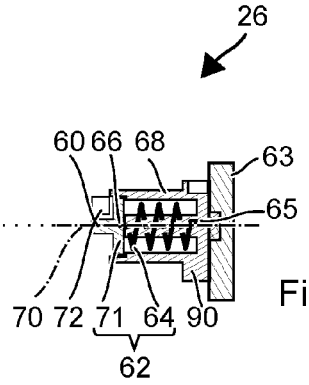
Figure 3C:
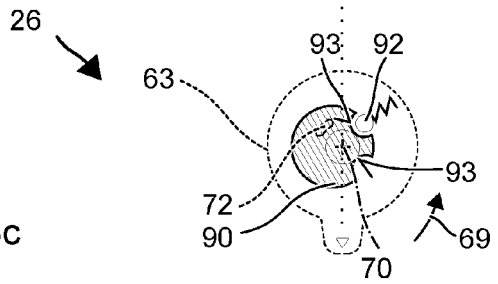
Figure 3E:
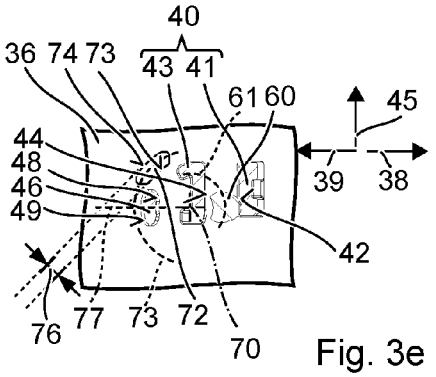
Figure 4A:
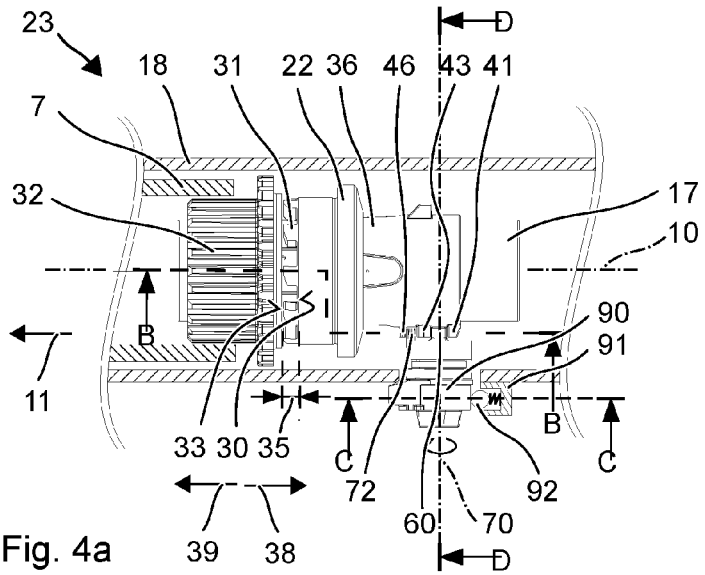
FIGS. 4*a*-4*e*: a gear with a selector switch in a transition position.
Figure 4B:
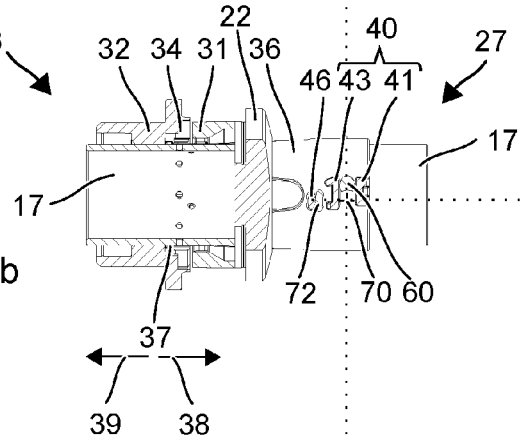
Figure 4D:
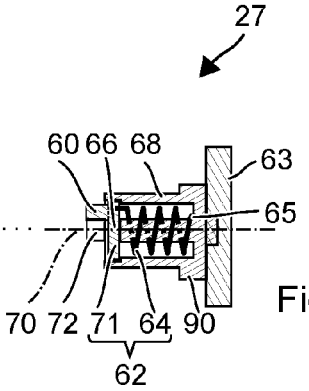
Figure 4C:
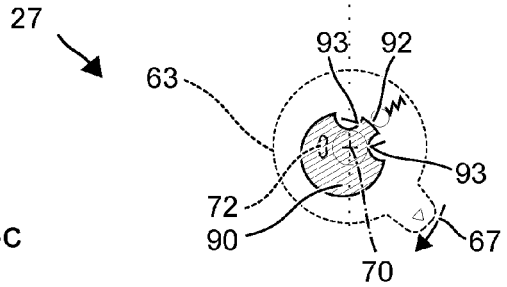
Figure 4E:
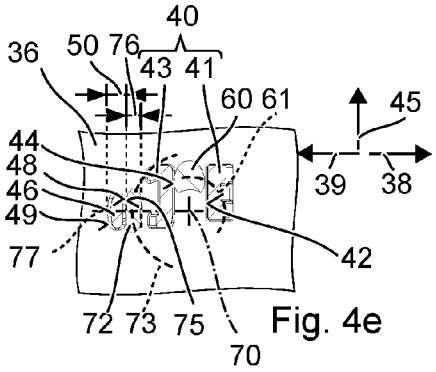
Figure 5A:
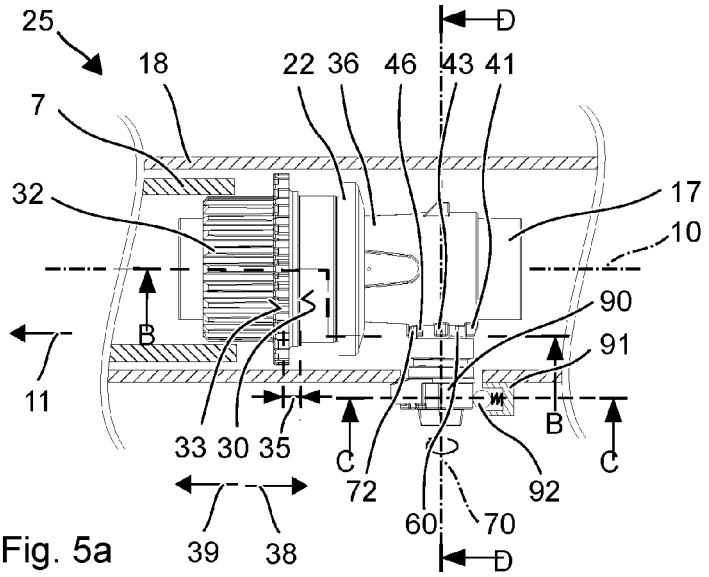
FIGS. 5*a*-5*e*: a gear with a selector switch in another transition position.
Figure 5B:
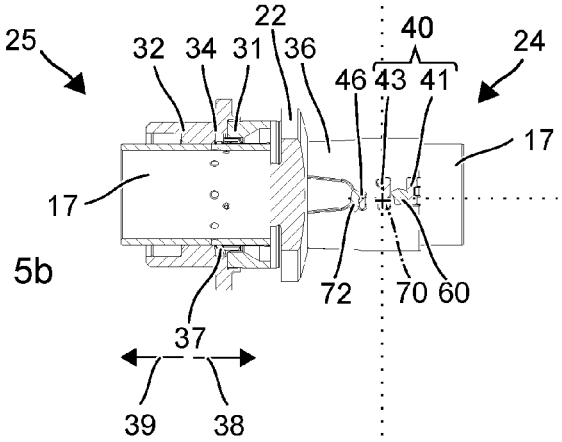
Figure 5D:
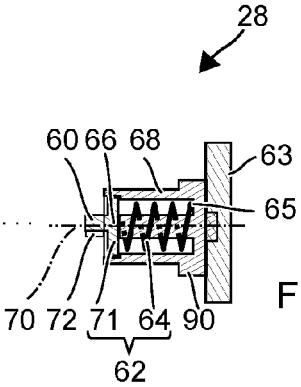
Figure 5C:
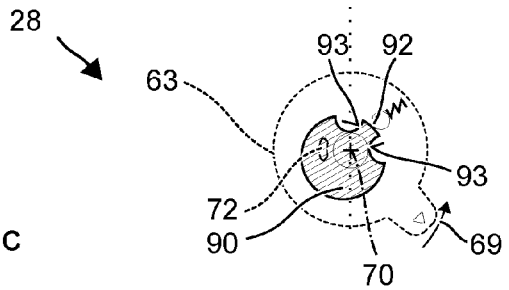
Figure 5E:
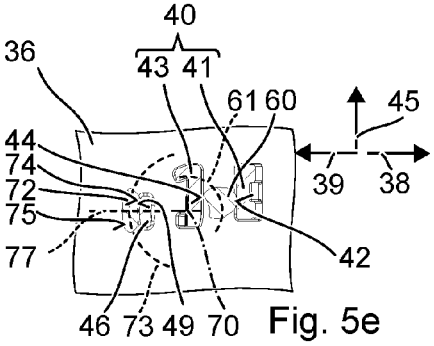

FIG. 2*a* shows several gear components and the selector switch 20 in a side view. The schematically depicted machine housing 18 is shown in a cut open view. FIG. 2*b* shows the gear components in a section along the folded plane B-B in FIG. 2*a*. The plane B-B runs partially through the working axis 10 and then runs offset through an area in which the selector switch 20 engages with one of the gear components. FIG. 2*c* is a cross section through the selector switch 20 in the plane C-C depicted in FIG. 2*a*. FIG. 2*d* is a longitudinal section through the selector switch 20 in the plane D-D; see FIG. 2*a*. FIG. 2*e* shows an enlarged section of FIG. 2*b*. FIGS. 3*a* to 3*e*, 4*a* to 4*e* and 5*a* to 5*e* are analogous.

The mode of operation of the selector switch 20 will be illustrated below on the basis of four positions given by way of examples. In a first operating position 23, the driven shaft 7 is uncoupled, the hammer drill 1 has a purely chiseling function (FIGS. 2*a* to 2*e*). The selector switch 20 is in a corresponding first switching position 24. Preferably, the selector switch 20 latches in this switching position 24. In a second operating position 25, the driving pinion 22 drives the driven shaft 7, and the hammer drill 1 has a turning-chiseling function (FIGS. 3*a* to 3*e*). The selector switch 20 is in a second switching position 26 in which the selector switch 20 preferably likewise latches. When the selector switch 20 changes out of the first switching position 24 into the second switching position 26, it passes through several intermediate or transition positions 27, two of which are shown by way of examples. A first intermediate position 27 results from the change out of the first switching position 24 into the second switching position 26; the selector switch 20 is shown by way of an example halfway between the two switching positions 24, 26 (FIGS. 4*a* to 4*e*). The hammer drill 1 here is in the first operating position 23. The second intermediate position 28 shows the selector switch 20 likewise halfway between the first switching position 24 and the second switching position 26, only this time during a movement starting from the second switching position 26 (FIGS. 5*a* to 5*e*). The hammer drill 1 here is in the second operating position 25.

By way of an example, the driving pinion 22 here is configured as a bevel wheel (for the sake of simplicity, the teeth are not shown) which rotates around the working axis 10. The pinion 22 meshes on the driving side with another bevel wheel 29. The two bevel wheels 22, 29 are mounted in the machine housing 18 unmovably along the working axis 10. The pinion 22 has several claws 31 on its front 30 facing in the striking direction 11. Across from the claws 31, there is a hollow wheel 32 that can be moved along the working axis 10 and that is mounted rotatably around the working axis 10. A front 33 of the hollow wheel 32 facing the pinion 22 is provided with counterparts 34 that match the claws 31 in such a manner that the claws 31 can engage with said counterparts 34 (FIG. 3). The hollow wheel 32 can be moved relative to the pinion 22 by at least a distance 35 in order to disengage the claws 31 and the counterparts 34 (FIG. 2*a*). The hollow wheel 32 has axially running teeth that mesh with the driven shaft 7.

The hollow wheel 32 is connected to a gear linkage 36 that transmits the action of the selector switch 20 to the hollow wheel 32. The gear linkage 36 can be moved along the working axis 10. A pin 37 engages into the hollow wheel 32 in order to transmit the movement of the selector switch 20 to the hollow wheel 32 in a first switching direction 38 or in an opposite second switching direction 39 of the gear linkage 36, here, both parallel to the working axis 10.

In the embodiment shown, the gear linkage 36 is tubular and is mounted on the guide tube 17. The gear linkage 36 and the guide tube 17 can preferably be moved relative to each other along the working axis 10. The pinion 22 is hollow and is placed onto the tubular gear linkage 36. In this manner, the gear linkage 36 can pass through the pinion 22 without affecting the rotational movement of the pinion 22. In one embodiment, the gear linkage 36 can be bonded integrally to the hollow wheel 32 or else joined rigidly.

The gear linkage 36 has a link 40. The link 40 runs slanted relative to the switching direction 38 of the gear linkage 36, namely, perpendicular to the working axis 10 in the example shown. A first bar 41 has a running surface 42 that limits the link 40 in the switching direction 38, while a second bar 43 has a running surface 44 that limits the link 40 opposite from the switching direction 38. The two running surfaces 42, 44 are preferably parallel to each other, in other words, the link 40 has a constant width along its course. This course can be, for instance, rectilinear. As depicted, one running direction 45 of the link 40 can be essentially exactly perpendicular to the switching direction 38 or else slanted relative to it, for example, between 45° and 80°. In an alternative embodiment, the link 40 is formed by a groove in the gear linkage 36.

The gear linkage 36 has a locking pin 46 that is arranged at a fixed distance 47 from the link 40. The locking pin 46 is preferably arranged in the switching direction 38 or in the opposite switching direction 39 so as to be offset relative to the connection link 40 by a distance 47. The locking pin 46 has a first stop surface 48 facing in the switching direction 38. On the opposite side, the locking pin 46 has a second stop surface 49 that faces in the opposite switching direction 39. The stop surfaces 48, 49 are preferably parallel to the running direction 45 of the connection link 40, that is to say, to their running surfaces 42, 44. The width 50 of the locking pin 46, in other words, the distance 50 between the first stop surface 48 and the second stop surface 49 along the switching direction 39, is smaller than the distance 35 by which the hollow wheel 32 can be moved relative to the pinion 22 for coupling and uncoupling purposes. The link 40 is preferably longer than the locking pin 46 relative to the running direction of the link 40.

The selector switch 20 has a switching pin 60 that engages into the link 40. The switching pin 60 runs along a trajectory 61 prescribed by the selector switch 20. The trajectory 61 is slanted relative to the course of the link 40, as a result of which a movement of the switching pin 60 results in a force being exerted onto the gear linkage 36 along one of the switching directions 38, 39. If movement in the switching direction 38, 39 of the gear linkage 36 is not blocked, the gear linkage 36 moves in the desired switching direction 38, 39 due to the force.

The selector switch 20 has a traveling coupling 62 by means of which the switching pin is coupled positively, but not rigidly, to a grip element 63 held by a user. The traveling coupling 62 contains an energy-storing element, for example, a mechanical spring 64. One end 65 of the spring 64 is rigidly joined to the grip element 63 while the other end 66 of the spring 64 is rigidly joined to the switching pin 60. Owing to the traveling coupling 62, the switching pin 60 follows in the actuation direction 67 of the grip element 63. If the movement of the switching pin 60 is blocked, the force applied when the grip element 63 is turned is stored in the traveling coupling 62. Once the blocking has been released, the switching pin 60 catches up with the movement of the grip element 63 driven by the traveling coupling 62.

Instead of the preferred variant with precisely one spring 64, it is possible for two springs to be integrated into the selector switch 20. For instance, when the selector switch 20 is actuated, one of the springs is tensioned in the first actuation direction 67, whereas the other spring is uncoupled from the grip element 67 or from the rotary disk 71 in the first actuation direction 67, for example, it is detached from a stop surface. In the case of actuation in the opposite second actuation direction 69, the other spring is tensioned and the one spring remains unstressed. Moreover, the spring is preferably a metal spring for purposes of achieving a high spring constant in a small installation space. However, it is likewise possible to employ a rubber strip or springs made of plastic.

The selector switch 20 shown is a rotary switch whose grip element 63 can be rotated around an axis 70. The selector switch 20 is attached to the machine housing 18 and the axis 70 is unmovable relative to the machine housing 18, in contrast to the gear linkage 36 and the hollow wheel 32.

A structure of the selector switch 20 given by way of an example comprises a rotary disk 71 that can be rotated around an axis 70 relative to the grip element 63. The rotary disk 71 can be positioned in a cylindrical housing 68 of the selector switch 20. The eccentric switching pin 60 is arranged on the rotary disk 71. The force-transmitting and energy-storing element of the traveling coupling 62 is a spring 64, preferably a helical spring arranged coaxially to the axis 70. One end 65 of the spring 64 is rigidly joined to the grip element 63 while the other end 66 of the spring 64 is rigidly joined to the rotary disk 71. A rotation of the grip element 63 brings about a torsion of the spring 64, which translates into an immediate rotation of the rotary disk 71, or else a delayed rotation if the movement was blocked.

The selector switch 20 has a locking bolt 72 that is arranged so as to be unmovable relative to the grip element 63. Consequently, the locking bolt 72 is positively driven by the selector switch 20, in other words, the locking bolt 72 always immediately follows the movement of the grip element 63, in contrast to the force-coupled switching pin 60. The switching pin 60 and the locking bolt 72 are uncoupled via the traveling coupling 62.

The locking bolt 72 moves along a trajectory 73 that is slanted relative to the switching directions 38, 39. In the case of the rotating selector switch 20 shown by way of an example, the locking bolt 72 is guided along a circular trajectory 73 relative to the axis 70. The locking bolt 72 has a first locking surface 74 facing towards the axis 70 and a locking surface 75 facing away from the axis 70. The width 76 of the locking bolt 72, that is to say, the distance between the first locking surface 74 and the second locking surface 75, is smaller than the distance 35. Preferably, the sum of the width 50 of the locking pin 46 and the width 76 of the locking bolt 72 is somewhat smaller, for example, 5% to 10%, than the distance 35.

The selector switch 20 is arranged in such a way that the trajectory 73 of the locking bolt 72 intersects a trajectory 77 of the locking pin 46 that runs along the switching directions 38, 39. The trajectory 77 of the locking pin 46 can be specified relative to a fixed point on the machine housing 18, for instance, the axis 70 of the selector switch 20. The locking pin 46 is at a first distance 78 from the axis 70 when in the first operating position 23, and at a second distance 79 when in the second operating position 25. The two distances 78, 79 are measured parallel to the switching direction 38. In the embodiment shown, the first distance 78 is greater than the second distance 79. The stroke, that is to say, the difference between the two distances 78, 79, corresponds to the distance 35.

In the first switching position 24 (FIGS. 2*a* to 2*e*), the locking bolt 72 is offset relative to the locking pin 46 perpendicular to the switching direction 38 to such an extent that the locking pin 46 and the locking bolt 72 do not overlap in a projection onto a plane perpendicular to the switching direction 38. Consequently, the gear linkage 36 can be moved in the switching direction 38 without being blocked by the locking bolt 72. Analogously, in the second switching position 26 (FIGS. 3*a* to 3*e*), the locking pin 46 and the locking bolt 72 are projected onto the plane without overlap. The gear linkage 36 can be moved in the opposite switching direction 39, without being blocked by the locking bolt 72. The length 80 of the locking pin 46, that is to say, its dimension along the trajectory 73 of the locking bolt 72, is somewhat smaller than the distance 81 between the locking bolt 72 in the first switching position 24 and the locking bolt 72 in the second switching position 26. The difference is preferably within the range from 5% to 10%.

On its way from the first switching position 24 to the second switching position 26, the locking bolt 72 intersects the trajectory 77 of the locking pin 46. FIGS. 4*a* to 4*e* show an intermediate position 27 by way of an example. The second locking surface 75 of the locking bolt 72 is in contact with the first stop surface 48 of the locking pin 46. The movement in the first switching direction 38 of the locking pin 46 and thus of the gear linkage 36 is blocked. For this reason, the gear linkage 36 remains in the first operating position 24. The spring 64 of the traveling coupling 62 is tensioned when the grip element 63 is actuated. The spring 64 exerts force onto the switching pin 60 and presses it against the link 40 in the first switching direction 38. The blocking is released when the user turns the grip element 63 further to the second switching position 26. The traveling coupling 62 is released and it pushes the gear linkage 36 in the first switching direction 38 until the second switching position 26 has been reached (FIGS. 3*a* to 3*e*).

On its way from the second switching position 26 to the first switching position 24, the locking bolt 72 likewise intersects the trajectory 77 of the locking pin 46 in several intermediate positions 28 (FIGS. 5*a* to 5*e*). The first locking surface 74 of the locking bolt 72 is in contact with the second stop surface 49 of the locking pin 46, as a result of which movement out of the second operating position 25 into the second switching direction 39 is blocked. The traveling coupling 62 is tensioned when the grip element 63 is moved in the second direction of movement 69, as a result of which the switching pin 60 exerts a force onto the gear linkage 36 in the second switching direction 39. As soon as the grip element 63 has reached the second switching position 26, the blocking by the locking bolt 72 is released and the gear linkage 36 is pushed in the first switching direction 38 by the traveling coupling 62.

The selector switch 20 shown is configured as a rotary switch and has an axis 70 that is fixed relative to the machine housing 18. An alternative embodiment is a sliding switch whose grip element can be moved obliquely to the switching direction 38 in the machine housing 18. The locking bolt is connected to the grip element and runs along a trajectory that intersects the trajectory 77 of the locking pin 46. A switching pin of the selector switch is coupled to the grip element by means of springs that act along the switching direction, and the switching pin engages into the link 40.

In another embodiment, the selector switch 20 is configured as a sliding switch. A grip element of the selector switch can only be moved perpendicular to the switching direction 38. The locking bolt intersects the trajectory 77 of the locking pin. A locking pin of the selector switch engages into the link on the gear linkage 36. The link runs in the opposite direction from the switching direction 38. The switching pin is coupled to the grip element by means of springs. The slant between the running direction of the link and the trajectory of the switching pin ensures that the springs have a force component that acts along the switching direction 38.

The selector switch 20 preferably has a cam disk 90 that is rigidly joined to the grip element 63. A latching element 91 with spring-loaded pawls or balls 92 is attached to the machine housing 18. The pawls or balls 92 can latch into depressions 93 of the cam disk 90 in the first switching position 24 and in the second switching position 26. The pawls or balls 92 cannot latch on the way between the two switching positions 24, 26, in other words, in all of the intermediate positions 27, 28. Instead of a cam disk 90 on the selector switch 20, the latter can be provided with spring-loaded pawls that engage into depressions on the machine housing 18.

What is claimed is:

1. A handheld power tool comprising:

a switchable gear component movable along a first direction out of a first operating position into a second operating position;

a selector switch having a first switching position associated with the first operating position of the gear component and a second switching position associated with the second operating position of the gear component, the selector switch movable out of the first switching position into the second switching position via intermediate positions;

a traveling coupling coupled between the selector switch and the gear component, the traveling coupling including a spring exerting a force onto the gear component in the first direction when the selector switch is moved out of the first switching position into the second switching position; and a locking bolt coupled to the selector switch in a positively driven manner, so that, when the selector switch is in the intermediate positions of the selector switch, the locking bolt is moved into a blocking bolt position in which the locking bolt blocks movement of the gear component out of the first operating position into the second operating position, and, when the selector switch is in the second switching position, the locking bolt is moved into a releasing bolt position in which the locking bolt does not block movement of the gear component; wherein the gear component has a locking pin with whose side facing in the first direction the locking bolt is contactable in the blocking bolt position, and in the releasing bolt positions, the locking bolt is offset without overlap relative to the locking pin in a direction perpendicular to the first direction of the gear component.

2. The handheld power tool as recited in claim 1 wherein when a change is made out of the first operating position into the second operating position, the locking bolt is guided along a first trajectory, and, when a change is made out of the first switching position into the second switching position, the locking bolt is guided along a second trajectory, the first trajectory and the second trajectory intersecting each other.

3. A handheld power tool comprising:

a switchable gear component movable along a first direction out of a first operating position into a second operating position;

a selector switch having a first switching position associated with the first operating position of the gear component and a second switching position associated with the second operating position of the gear component, the selector switch movable out of the first switching position into the second switching position via intermediate positions;

a traveling coupling coupled between the selector switch and the gear component, the traveling coupling including a spring exerting a force onto the gear component in the first direction when the selector switch is moved out of the first switching position into the second switching position; and a locking bolt coupled to the selector switch in a positively driven manner, so that, when the selector switch is in the intermediate positions of the selector switch, the locking bolt is moved into a blocking bolt position in which the locking bolt blocks movement of the gear component out of the first operating position into the second operating position, and, when the selector switch is in the second switching position, the locking bolt is moved into a releasing bolt position in which the locking bolt does not block movement of the gear component wherein the selector switch is rotatable around an axis, and the locking bolt is attached eccentrically to the axis on the selector switch; and wherein the gear component has a locking pin that, in the first operating position, is at a second distance from the axis, and that, in the second operating position, is at a third distance from the axis, the first distance between the locking bolt and the axis being smaller than the second distance and greater than the third distance.

4. A handheld power tool comprising:

a switchable gear component movable along a first direction out of a first operating position into a second operating position;

a selector switch having a first switching position associated with the first operating position of the gear component and a second switching position associated with the second operating position of the gear component, the selector switch movable out of the first switching position into the second switching position via intermediate positions;

a traveling coupling coupled between the selector switch and the gear component, the traveling coupling including a spring exerting a force onto the gear component in the first direction when the selector switch is moved out of the first switching position into the second switching position; and a locking bolt coupled to the selector switch in a positively driven manner, so that, when the selector switch is in the intermediate positions of the selector switch, the locking bolt is moved into a blocking bolt position in which the locking bolt blocks movement of the gear component out of the first operating position into the second operating position, and, when the selector switch is in the second switching position, the locking bolt is moved into a releasing bolt position in which the locking bolt does not block movement of the gear component; wherein in the blocking bolt position, the locking pin is in contact with the locking bolt when force is exerted by the spring in the first direction or opposite from the first direction.

5. A handheld power tool comprising:

a switchable gear component movable along a first direction out of a first operating position into a second operating position;

a selector switch having a first switching position associated with the first operating position of the gear component and a second switching position associated with the second operating position of the gear component, the selector switch movable out of the first switching position into the second switching position via intermediate positions;

a traveling coupling coupled between the selector switch and the gear component, the traveling coupling including a spring exerting a force onto the gear component in the first direction when the selector switch is moved out of the first switching position into the second switching position; and a locking bolt coupled to the selector switch in a positively driven manner, so that, when the selector switch is in the intermediate positions of the selector switch, the locking bolt is moved into a blocking bolt position in which the locking bolt blocks movement of the gear component out of the first operating position into the second operating position, and, when the selector switch is in the second switching position, the locking bolt is moved into a releasing bolt position in which the locking bolt does not block movement of the gear component; wherein the traveling coupling has a rotary disk rotatable around an axis of the selector switch, the spring being firmly joined to the selector switch at one end and to the rotary disk at the other end, and an eccentric switching pin on the rotary disk engages into a link running obliquely or perpendicularly to the first axis and that is situated on the gear component.

6. The handheld power tool as recited in claim 5 wherein the spring is deflectable under tension around the axis out of a resting position in a first direction of rotation, and in a second direction of rotation opposite from the first direction of rotation.

7. The handheld power tool as recited in claim 5 wherein a fourth distance between the eccentric switching pin and the axis is smaller than the first distance between the locking pin and the axis.

* * * * *